US009265997B1

(12) United States Patent
Good, Jr. et al.

(10) Patent No.: US 9,265,997 B1
(45) Date of Patent: Feb. 23, 2016

(54) GOLF BALL RETRIEVING SYSTEM, INCLUDING A MAGNETIC RETRIEVER AND A GOLF BALL ATTRACTED THERETO

(75) Inventors: Hugh B. Good, Jr., Pickerington, OH (US); Steven A. Sauer, Columbus, OH (US); Jeffrey D. Myers, Upper Arlington, OH (US)

(73) Assignee: Hugh B. Good, Jr., Pickerington, OH (US)

( * ) Notice: Subject to any disclaimer, the term of this patent is extended or adjusted under 35 U.S.C. 154(b) by 736 days.

(21) Appl. No.: 13/474,638

(22) Filed: May 17, 2012

(51) Int. Cl.
*A63B 57/00* (2015.01)
*A63B 47/02* (2006.01)
*A63B 53/14* (2015.01)

(52) U.S. Cl.
CPC ..... *A63B 53/14* (2013.01); *A63B 2209/08* (2013.01); *A63B 2243/0029* (2013.01)

(58) Field of Classification Search
USPC ..... 473/286, 373; 294/19.2, 282, 285, 288
See application file for complete search history.

(56) References Cited

U.S. PATENT DOCUMENTS

| | | | | |
|---|---|---|---|---|
| 2,218,825 | A | 10/1940 | Le Guillou | |
| 3,891,221 | A * | 6/1975 | Gordon | 473/174 |
| 5,282,619 | A * | 2/1994 | Napolitano et al. | 473/239 |
| 5,437,457 | A * | 8/1995 | Curchod | 473/199 |
| 5,478,612 | A * | 12/1995 | Hack et al. | 428/11 |
| 5,690,558 | A | 11/1997 | Huber | |
| 6,458,047 | B1 * | 10/2002 | Nesbitt | 473/372 |
| 6,514,157 | B2 | 2/2003 | Jordan et al. | |
| 7,178,844 | B2 * | 2/2007 | Evilsizer | 294/19.2 |
| 7,390,268 | B2 | 6/2008 | Merriman | |
| 7,682,265 | B2 | 3/2010 | VanDelden | |
| 7,976,407 | B2 | 7/2011 | VanDelden | |
| 8,052,542 | B1 * | 11/2011 | Cepin | 473/286 |
| 2002/0022539 | A1 | 2/2002 | Smith et al. | |
| 2003/0083142 | A1 | 5/2003 | Nam | |
| 2005/0181886 | A1 * | 8/2005 | Zmetra | 473/286 |
| 2007/0049396 | A1 * | 3/2007 | Scheibe | 473/282 |
| 2007/0219012 | A1 | 9/2007 | Merriman | |
| 2008/0220899 | A1 | 9/2008 | Sullivan et al. | |
| 2008/0261714 | A1 | 10/2008 | Bae | |
| 2009/0203461 | A1 | 8/2009 | Miller | |
| 2011/0053701 | A1 | 3/2011 | Eddings | |

FOREIGN PATENT DOCUMENTS

| | | | |
|---|---|---|---|
| CA | 2228567 | A1 | 8/1998 |
| CA | 2598749 | A1 | 8/2006 |
| DE | 10217370 | A1 | 6/2003 |
| GB | 2201100 | A | 8/1988 |

* cited by examiner

*Primary Examiner* — Nini Legesse
(74) *Attorney, Agent, or Firm* — The Law Office of Patrick F. O'Reilly, III, LLC

(57) ABSTRACT

A golf ball retrieving system, which includes a magnetic golf ball retriever and a golf ball attracted thereto, is disclosed herein. The golf ball retriever includes an elongated rod assembly and a body portion having a circular magnet. The elongated rod assembly is connected to the body portion at one of its ends, and extends radially outward from the circular magnet of the body portion. The golf ball includes a metallic material disposed in one of: (i) an inner core, (ii) at least one mantle layer, (iii) an outer skin, (iv) a space between the inner core and the outer skin, (v) a space between the inner core and the at least one mantle layer, and (vi) a space between the at least one mantle layer and the outer skin. The metallic material provided in the golf ball is in the form of a ferrous powder.

11 Claims, 9 Drawing Sheets

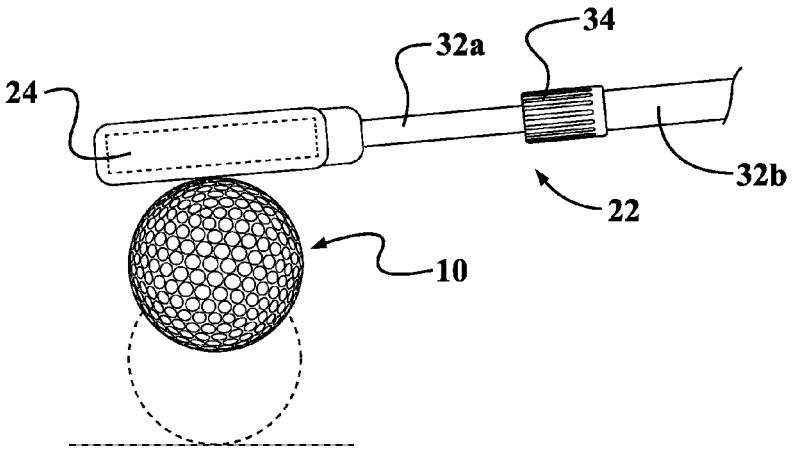
FIG.16
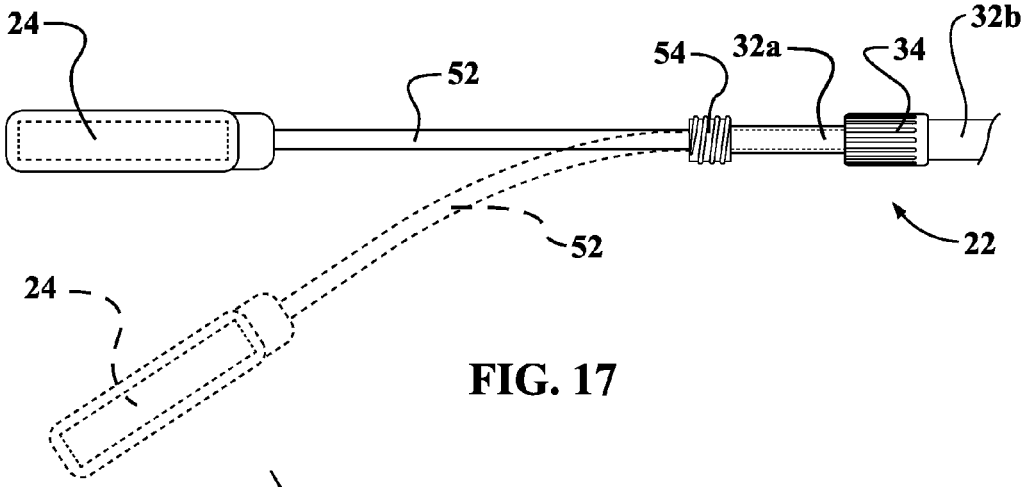
FIG. 17
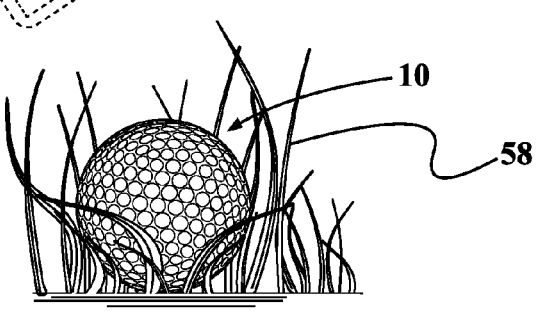

GOLF BALL RETRIEVING SYSTEM, INCLUDING A MAGNETIC RETRIEVER AND A GOLF BALL ATTRACTED THERETO

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a golf ball retrieving system, which includes a magnetic retriever and a golf ball attracted thereto. More particularly, the invention relates to a magnetic golf ball retriever that is configured to retrieve a golf ball having a metallic material disposed therein.

2. Background

Golf is one of the few sports that can be readily enjoyed by people of all ages. As such, the popularity of this sport has been increasing rapidly for many years. In response to such demand, many new golf courses have been developed in and around metropolitan areas throughout the country. Moreover, billions of dollars have been spent on the development of high performance golf equipment, such as golf clubs and balls. Naturally, the high development costs of this sophisticated golf equipment are passed on to the consumer. As a result, the golf equipment that is used by even an average golfer tends to be quite costly. While golf clubs typically can be used for many years without the need for replacement, unfortunately, the same cannot be said for golf balls.

In order to make play more interesting and challenging for their golfers, most golf courses comprise a myriad of different hazards that include, but are not limited to, water hazards in the form of ponds and creeks, sand traps and bunkers, wooded areas, tall grass, and other areas of dense vegetation. Quite frequently, golfers are unable to find their golf balls once they enter one of these common golf course hazards. Also, even if a player is fortunate enough to find his or her golf ball after it enters one of these hazards, there is often insufficient time to retrieve the golf ball because of the need to maintain a steady pace of play on the course. In many of these hazards, there are often a large number of golf balls that have not been retrieved because checking each ball takes far too much time, especially when they are sometimes difficult to reach (i.e., the ball is located in brush or behind fallen trees/limbs). Thus, once the golf ball enters one of these hazards, it is often lost forever. Over time, this eventually necessitates the purchase of new, often quite expensive, golf balls by the player. As such, regular golfers expend significant financial resources on the replacement of golf balls lost in the hazards of a typical golf course.

Therefore, what is needed is a golf ball retrieving system, which includes a golf ball retriever and a golf ball attracted thereto, that significantly reduces the quantity of golf balls that are lost during a typical round of golf. The golf ball utilized in such a system would be readily retrievable in a fraction of time that is required for that of a conventional golf ball. Moreover, the golf ball retrieving system would even facilitate the retrieval of a golf ball that is hidden from view (e.g., a golf ball buried under leaves, tucked in tall grass, or lying in murky water) or is located in close proximity to a large number of conventional golf balls. Furthermore, what is needed is a golf ball retrieving system that utilizes a golf ball having the aforementioned benefits, but which is still compliant with the rules and regulations set forth by the United States Golf Association ("USGA®").

BRIEF SUMMARY OF THE INVENTION

Accordingly, the present invention is directed to a a golf ball retrieving system, which includes a magnetic retriever and a golf ball attracted thereto, that substantially obviates one or more problems in the art hereinbefore discussed.

In accordance with one aspect of the present invention, there is provided a golf ball retriever configured to retrieve a golf ball having a metallic material disposed therein, which includes: an elongated rod assembly; and a body portion, the elongated rod assembly being connected to the body portion at one of its ends, the body portion including a circular magnet that is configured to magnetically attract the golf ball with the metallic material disposed therein. In this embodiment, the elongated rod assembly extends radially outward from the circular magnet of the body portion.

In a preferred embodiment of this aspect of the present invention, the elongated rod assembly comprises a plurality of telescoping tubular members such that the extending length of the golf ball retriever is capable of being adjusted.

In another preferred embodiment, the elongated rod assembly further includes a flexible inner rod disposed within an innermost one of the plurality of telescoping tubular members, the flexible inner rod having a first end that is fixedly attached to the body portion and a second, opposed end that is slidably disposed within an interior portion of the innermost one of the plurality of telescoping tubular members; and a coupling member disposed on a first end of the innermost one of the plurality of telescoping tubular members, the coupling member including a plurality of external threads disposed about the periphery thereof. In this preferred embodiment, the flexible inner rod is fixed in place relative to the innermost one of the plurality of telescoping tubular members when the external threads of the coupling member are engaged with complementary internal threads disposed on the body portion, and wherein the flexible inner rod is extendable from the innermost one of the plurality of telescoping tubular members when the external threads of the coupling member are disengaged from the complementary internal threads of the body portion.

In yet another preferred embodiment, the circular magnet of the body portion is encased within a polymeric material.

In still another preferred embodiment, the body portion further comprises a cup portion defined by a cylindrical wall disposed about the periphery of the circular magnet and extending axially outward therefrom, the cylindrical wall having an inwardly concave shape such that the cup portion is capable of frictionally engaging the golf ball.

In yet another preferred embodiment, the end of the cup portion disposed opposite to the circular magnet is open so as to permit the receiving of the golf ball into the cup portion.

In still another preferred embodiment, the end of the cup portion disposed opposite to the circular magnet is solid, and the cylindrical wall of the cup portion is provided with an aperture disposed therein so as to permit the receiving of the golf ball into the cup portion.

In yet another preferred embodiment, the body portion further comprises a ring portion defined by an annular wall disposed adjacent to the circular magnet, the annular wall disposed about a central axis that is oriented generally transversely with respect to a central axis of the circular magnet, and the annular wall having an inwardly concave shape such that the ring portion is capable of frictionally engaging the golf ball.

In still another preferred embodiment, the circular magnet comprises neodymium.

In yet another preferred embodiment, the circular magnet has a residual flux density of approximately 13,200 gauss.

In still another preferred embodiment, the circular magnet comprises one of the following: (i) a disk-shaped magnet; and (ii) a ring-shaped magnet.

In accordance with another aspect of the present invention, there is provided a golf ball, which includes: (a) two-piece ball construction with an inner core and an outer skin surrounding the inner core or (b) at least three-piece ball construction with an inner core, at least one mantle layer surrounding the inner core, and an outer skin surrounding the at least one mantle layer; and a metallic material disposed in one of: (i) the inner core, (ii) the at least one mantle layer, (iii) the outer skin, (iv) a space between the inner core and the outer skin, (v) a space between the inner core and the at least one mantle layer, and (vi) a space between the at least one mantle layer and the outer skin, the metallic material being in the form of a ferrous powder, wherein the ferrous powder is provided in an amount ranging from approximately 4% to approximately 26% of the overall weight of the golf ball.

In a preferred embodiment of this aspect of the present invention, the ferrous powder is of the ultra-pure type.

In another preferred embodiment, the ferrous powder has a density of approximately 3 grams per cubic centimeter.

In yet another preferred embodiment, the ferrous powder is dispersed in the inner core.

In still another preferred embodiment, the ferrous powder is dispersed in the at least one mantle layer.

In yet another preferred embodiment, the ferrous powder is dispersed in the outer skin.

In still another preferred embodiment, the ferrous powder is disposed in the space between the inner core and the outer skin.

In accordance with yet another aspect of the present invention, there is provided a golf ball retrieving system comprising: a golf ball having (a) two-piece ball construction with an inner core and an outer skin surrounding the inner core or (b) at least three-piece ball construction with an inner core, at least one mantle layer surrounding the inner core, and an outer skin surrounding the at least one mantle layer; and a metallic material disposed in one of: (i) the inner core, (ii) the at least one mantle layer, (iii) the outer skin, (iv) a space between the inner core and the outer skin, (v) a space between the inner core and the at least one mantle layer, and (vi) a space between the at least one mantle layer and the outer skin, the metallic material being in the form of a ferrous powder; and a golf ball retriever configured to retrieve the golf ball, which includes: an elongated rod assembly; and a body portion, the elongated rod assembly being connected to the body portion at one of its ends, the body portion including a circular magnet that is configured to magnetically attract the golf ball with the ferrous powder disposed therein. In this embodiment, the elongated rod assembly of the golf ball retriever extends radially outward from the circular magnet of the body portion.

In a preferred embodiment of this aspect of the present invention, the golf ball retriever is configured to exert an attraction force ranging from approximately 0.90 Newtons to approximately 21.6 Newtons on the golf ball.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 16 is a partial perspective view of the golf ball retriever axially grasping a golf ball according to an embodiment of the invention, wherein a flexible inner rod of the elongated rod assembly is in a retracted position;

FIG. 17 is a partial perspective view of the ball retriever body portion axially approaching a golf ball according to an embodiment of the invention, wherein a flexible inner rod of the elongated rod assembly is in an extended position;

Throughout the figures, the same parts are always denoted using the same reference characters so that, as a general rule, they will only be described once.

DETAILED DESCRIPTION OF THE PREFERRED EMBODIMENTS

Figure 1:
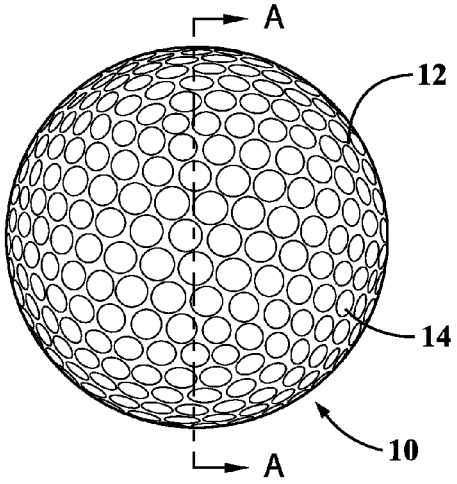
FIG. 1 is a perspective view of a golf ball according to an embodiment of the invention.

An embodiment of the inventive golf ball is seen generally at 10 in FIG. 1. As shown in FIG. 1, the golf ball 10 has an outer skin or cover 12 with a plurality of dimples 14 formed therein for improving the aerodynamic characteristics of the golf ball 10 during flight. In particular, the dimples 14 that are formed in the skin 12 of the golf ball 10 reduce pressure drag by creating a thin turbulent boundary layer of air that clings to the outer skin surface of the golf ball 10. The creation of the turbulent boundary layer permits the smoothly flowing air to follow the outer skin surface slightly further around the rear side of the golf ball 10 such that the size of the wake created thereby is decreased. The dimples 14 also increase the travel distance of the golf ball 10 by improving its lift properties.

In a preferred embodiment, the outer skin or cover 12 of the golf ball 10 is formed from a suitable polymeric material, such as SURLYN® by the E.I. DuPont De Nemours & Company of Wilmington, Del. However, one of ordinary skill in the art will readily appreciate that other suitable materials may be used for the outer skin 12 of the golf ball 10 as well.

Figure 2:
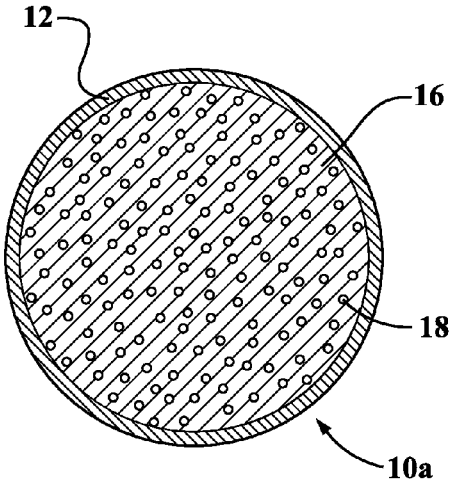
FIG. 2 is a sectional view of a two-piece golf ball with a metallic material disposed in the core thereof according to an embodiment of the invention, the section being cut along the cutting-plane line A-A in FIG. 1.
Figure 3:
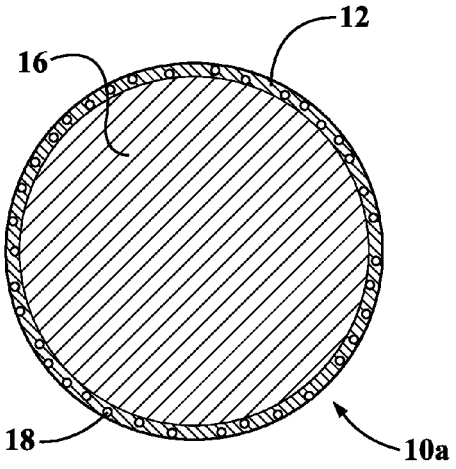
FIG. 3 is a sectional view of a two-piece golf ball with a metallic material disposed in the skin thereof according to an embodiment of the invention, the section being cut along the cutting-plane line A-A in FIG. 1.
Figure 4:
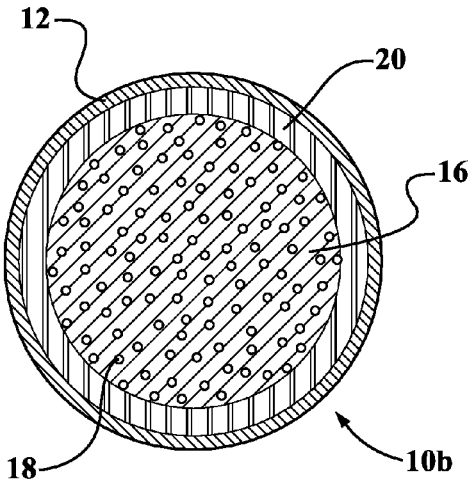
FIG. 4 is a sectional view of a three-piece golf ball with a metallic material disposed in the core thereof according to an embodiment of the invention, the section being cut along the cutting-plane line A-A in FIG. 1.
Figure 5:
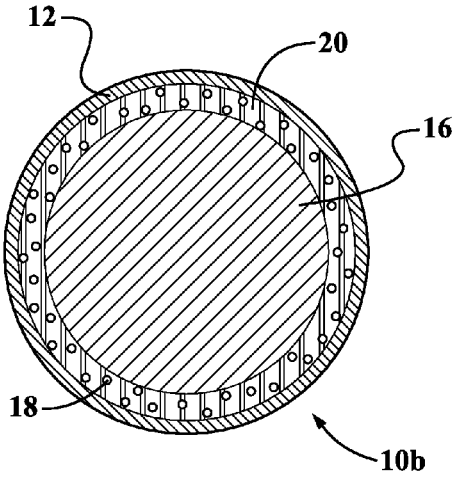
FIG. 5 is a sectional view of a two-piece golf ball with a metallic material disposed in the mantle thereof according to an embodiment of the invention, the section being cut along the cutting-plane line A-A in FIG. 1.
Figure 6:
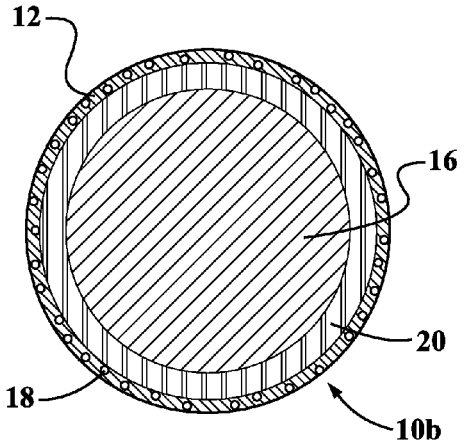
FIG. 6 is a sectional view of a two-piece golf ball with a metallic material disposed in the skin thereof according to an embodiment of the invention, the section being cut along the cutting-plane line A-A in FIG. 1.

The golf ball 10 can be of two-piece, three-piece, or four-or-more-piece construction depending on the specific desired performance characteristics thereof. Exemplary embodiments of golf balls 10*a* having a two-piece construction are illustrated in FIGS. 2-3, while exemplary embodiments of golf balls 10*b* having a three-piece construction are depicted in FIGS. 4-6. Because golf balls having four or more layers are very similar to that of the three-piece golf ball 10*b*, except for the inclusion of additional mantle layers, they are explicitly illustrated in the figures.

Referring to FIGS. 2 and 3, it can be seen that a two-piece golf ball 10*a* generally comprises an outer skin or cover 12 that surrounds an inner core 16. The inner core 16 preferably is made from a rubber or thermoplastic elastomer compound. However, those of ordinary skill in the art will readily appreciate that other suitable materials can be utilized for the inner core 16 as well.

Now, referring specifically to the embodiment in FIG. 2, the inner core 16 of the two-piece golf ball 10*a* is provided with a metallic material 18 dispersed throughout. In some embodiments, the inner core 16 of the golf ball 10*a* is infused with the metallic material 18, and the metallic material 18 is dispersed substantially uniformly throughout the volume of the inner core 16. Also, in one preferred embodiment of the invention, the metallic material 18 is in the form of a ferrous powder that is readily attracted to a permanent magnet (i.e., it is a magnetic type material).

More preferably, the metallic material 18 comprises an ultra-pure type ferrous powder having a percent by weight of iron (Fe) equal to 99.5% or greater. Also, the preferred ultra-pure type ferrous powder has a density of approximately 3 grams per cubic centimeter (3 g/cc).

Turning to the embodiment illustrated in FIG. 3, it can be seen that the metallic material 18 alternatively can be dispersed throughout the outer skin or cover 12 of the two-piece golf ball 10*a*. As described above with regard to the inner core 16, the outer skin 12 of the golf ball 10*a* can be infused with the metallic material 18, and the metallic material 18 can be dispersed substantially uniformly throughout the volume of the outer skin 12. The outer skin 12 of the golf ball 10*a* could also be painted, tinted, or coated with the metallic material 18. Alternatively, the metallic material 18 could be provided between the outer skin 12 and the inner core 16 of the two-piece golf ball 10*a* so as to form a metallic mantle layer within the golf-ball 10*a*. In such a case, the entire outer surface of the inner core 16 would preferably be covered with a substantially uniform layer of the metallic material 18 thereon.

A golf ball 10*b* having a three-piece construction is graphically illustrated in FIGS. 4-6. The three-piece golf ball 10*b* generally comprises an inner core 16, a mantle layer 20 that surrounds the inner core 16, and an outer skin or cover 12 that surrounds the mantle layer 20. The mantle layer 20 is sandwiched between the outer skin 12 and the inner core 16 and is preferably formed from a solid polymeric material, such as polybutadiene. Although, in other embodiments, the mantle layer 20 can be alternatively formed from a wound material (e.g., rubber thread) or a metallic material (e.g., steel or titanium), rather from a solid polymeric material.

Now, referring specifically to the embodiment in FIG. 4, it can be seen that the inner core 16 of the three-piece golf ball 10*b* is provided with a metallic material 18 dispersed throughout. As described above for the two-piece golf ball 10*a*, the inner core 16 of the golf ball 10*b* can be infused with the metallic material 18. Also, the metallic material 18 preferably is dispersed substantially uniformly throughout the volume of the inner core 16, and preferably comprises a ferrous powder that is readily attracted to a permanent magnet (i.e., it is a magnetic type material).

In the embodiment illustrated in FIG. 5, the metallic material 18 is alternatively dispersed throughout the mantle layer 20 of the three-piece golf ball 10*b*. As described above with regard to the inner core 16, the mantle layer 20 of the golf ball 10*b* can be infused with the metallic material 18, and the metallic material 18 can be dispersed substantially uniformly throughout the volume of the mantle layer 20. Alternatively, the metallic material 18 could be provided between the outer skin 12 and the mantle layer 20 of the three-piece golf ball 10*b* so as to form an additional mantle layer within the golf-ball 10*b*. In such a case, the entire outer surface of the mantle layer 20 would preferably be covered with a substantially uniform layer of the metallic material 18 thereon. As another possible alternative design, a substantially uniform layer of the metallic material 18 could be provided between the inner core 16 and the mantle layer 20 of the three-piece golf ball 10*b*, rather than between the outer skin 12 and the mantle layer 20.

Finally, in the FIG. 6 embodiment, it can be seen that the metallic material 18 alternatively can be dispersed throughout the outer skin or cover 12 of the three-piece golf ball 10*b*. As described above with regard to two-piece golf ball 10*a*, the outer skin 12 of the golf ball 10*b* can be infused with the metallic material 18, and the metallic material 18 can be dispersed substantially uniformly throughout the volume of the outer skin 12.

In one preferred embodiment of the invention, the ferrous powder is provided in an amount ranging from approximately 1% to approximately 52% of the overall weight of the golf ball (or between 1% and 52% of the weight), and more preferably between approximately 4% and approximately 26% (or between 4% and 26% of the weight). The low end of the range (i.e., approximately 1% or 1%) represents the minimum amount of ferrous powder that must be present in the golf ball for it to be lifted by a permanent, disk-type magnet having the characteristics described hereinafter. The high end of the range (i.e., approximately 52% or 52%) represents the maximum amount of internally dispersed ferrous powder that is required in the golf ball for it to be extracted out of a viscous material, such as clay or mud, without breaking the link between the golf ball and the permanent, disk-type magnet hereinafter described.

In another preferred embodiment, the golf ball 10 has design parameters that are in conformance with the rules and regulations of the United States Golf Association ("USGA®"). For example, the overall weight of the golf ball 10 is not greater than 1.620 ounces (45.93 grams) and the diameter of the golf ball is not less than 1.680 inches (42.67 mm). However, one of ordinary skill in the art will appreciate that, in other embodiments, the design parameters of the golf ball 10 could deviate from the standards set forth by the USGA®.

For a golf ball that is designed in accordance with the USGA® rules and regulations, and with an overall mass of 45.93 grams, the ferrous powder would be provided in an amount ranging from approximately 0.50 grams to approximately 24.00 grams (or between 0.50 and 24.00 grams), and more preferably between approximately 1.95 grams and approximately 12.00 grams (or between 1.95 and 12.00 grams).

Figure 7:
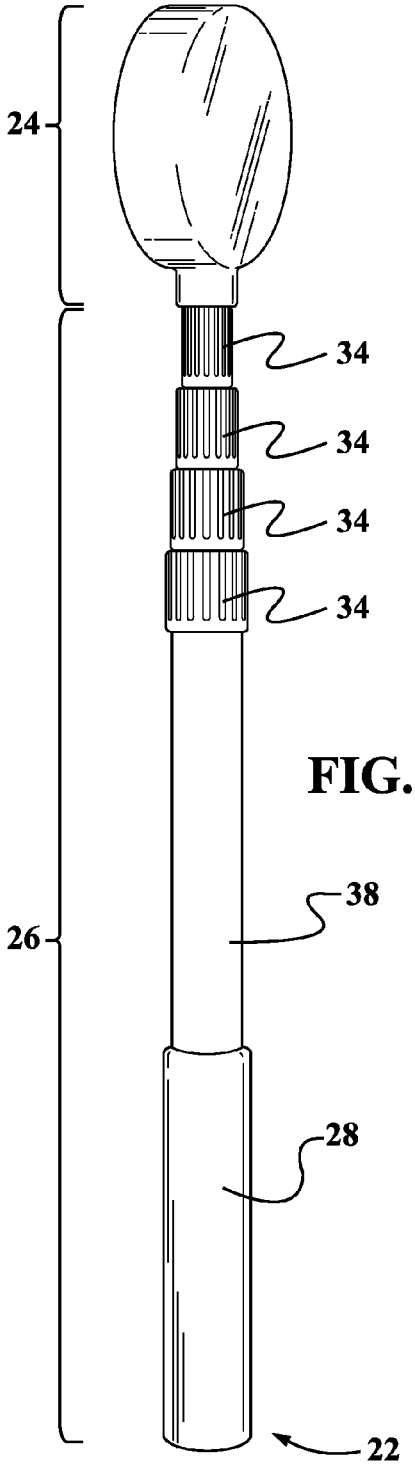
FIG. 7 is a perspective view of a golf ball retriever according to an embodiment of the invention, wherein the golf ball retriever is depicted in a retracted state.
Figure 8:
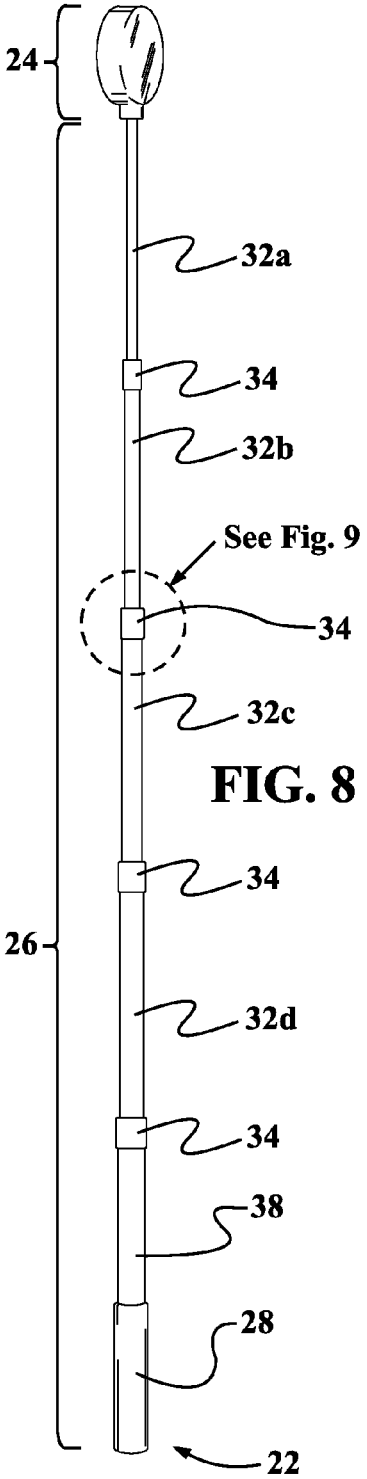
FIG. 8 is a perspective view of a golf ball retriever according to an embodiment of the invention, wherein the golf ball retriever is depicted in an extended state.

An embodiment of the inventive golf ball retriever is seen generally at 22 in FIGS. 7 and 8. The golf ball retriever 22 of the depicted embodiment principally comprises a body portion 24, an elongated rod assembly 26, and preferably, a gripping device 28. As seen in FIGS. 7 and 8, the elongated rod assembly 26 has two oppositely disposed end portions. The body portion 24 is connected to the first end portion of the elongated rod assembly 26, whereas the gripping device 28 is disposed around the outer circumference of the second end portion of the elongated rod assembly 26. In a preferred embodiment, the golf ball retriever 22 is configured to be used with the golf ball 10 described above. The body portion 24 of the golf ball retriever 22 includes a disk-shaped magnet 30 (see e.g., FIG. 11) that is configured to magnetically attract the golf ball 10 with the metallic material 18 disposed therein. A retracted state of the golf ball retriever 22 is illustrated in FIG. 7, whereas an extended state of the golf ball retriever 22 is shown in FIG. 8.

In FIGS. 7 and 8, it can be seen that the elongated rod assembly 26 is connected to the body portion 24 in such a manner that it extends radially outward from disk-shaped body portion 24 and the disk-shaped magnet 30 disposed therein. As best shown in FIG. 8, the elongated rod assembly 26 comprises a plurality of telescoping tubular members 32*a*-32*d* such that the extending length of the golf ball retriever 22 is capable of being adjusted. Advantageously, the use of the telescoping tubular members 32*a*-32*d* permits the overall size (i.e., the overall length) of the golf ball retriever 22 to be minimized when the golf ball retriever 22 is being transported by its user (e.g., in the golf bag of the user) so that it is not cumbersome to transport from place-to-place. For example, in one embodiment, the overall retracted length of the golf ball retriever 22 may be slightly greater than the length of a golf bag so that it can be inserted into the club carrying compartment of the golf bag along with the user's golf clubs. In another embodiment, the overall retracted length of the golf ball retriever 22 could be substantially less than the length of golf bag so that it can be stowed within a side compartment of the golf bag (e.g., a large, zippered compartment on the side of the golf bag). Then, when it is time to use the golf ball retriever 22 to, for example, retrieve a golf ball from a water hazard, the golf ball retriever 22 can be adjusted to its extended state (e.g., as depicted in FIG. 8).

In the embodiment illustrated in FIGS. 7 and 8, there are a total of four (4) generally rigid telescoping tubular members 32*a*-32*d* and one (1) outermost tubular member 38 on which the gripping device 28 is mounted. Telescoping tubular member 32*a*, which is directly attached to the body portion 24 of the golf ball retriever 22 is slidably received within telescoping tubular member 32*b*. Similarly, telescoping tubular member 32*b* is slidably received within telescoping tubular member 32*c*, and telescoping tubular member 32*c* is slidably received within telescoping tubular member 32*d*. Telescoping tubular member 32*d* is slidably received within the outermost tubular member 38 on which the gripping device 28 is mounted. While a total of four (4) generally rigid telescoping tubular members 32*a*-32*d* are depicted in the illustrated embodiment, one of ordinary skill in the art will appreciate that, in the other embodiments of the invention, more than four or less than four telescoping tubular members can be utilized.

Each of the tubular members 32*a*, 32*b*, 32*c*, 32*d*, 38 of the golf ball retriever 22 has a proximal end and a distal end. As used herein, the proximal end of each tubular member 32*a*, 32*b*, 32*c*, 32*d*, 38 shall refer to that end which is nearest to the body portion 24 of the golf ball retriever 22, whereas the distal end of each tubular member 32*a*, 32*b*, 32*c*, 32*d*, 38 shall refer to that end which is furthest from the body portion 24 and closest to the gripping device 28.

Figure 9:
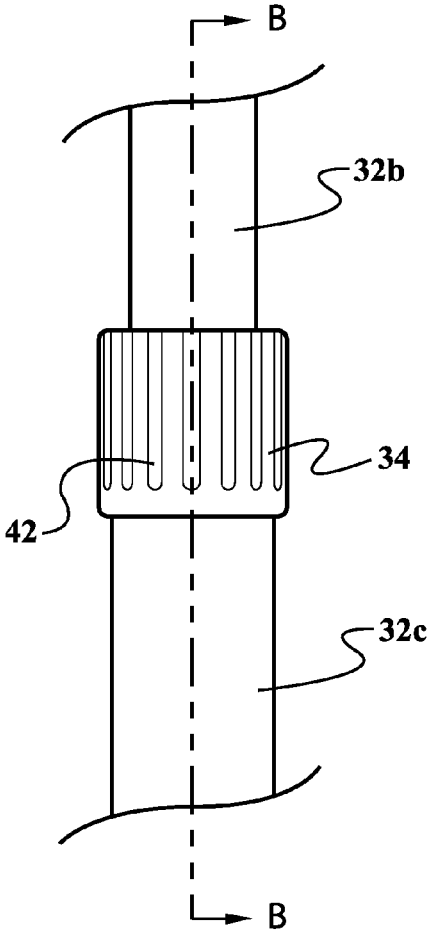
FIG. 9 is a partial, enlarged perspective view of a typical connector assembly of the golf ball retriever according to an embodiment of the invention.
Figure 10:
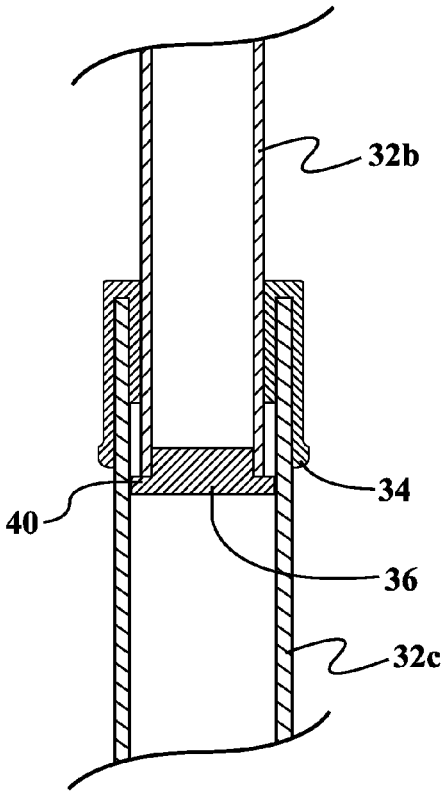
FIG. 10 is a partial sectional view of the typical connector assembly of the golf ball retriever according to an embodiment of the invention, which is cut along the cutting-plane line B-B in FIG. 9.

As illustrated in FIGS. 7 and 8, and more explicitly in FIGS. 9 and 10, the proximal ends of the telescoping tubular members 32*b*-32*d* and the proximal end of the outmost tubular member 38 are each preferably provided with a peripheral cap member 34 thereon so as to create a snugger fit between each tubular member 32*b*, 32*c*, 32*d*, 38 and the respective tubular member 32*a*, 32*b*, 32*c*, 32*d* that is slidingly received therein. The peripheral cap members 34 on the proximal ends of the tubular members 32*b*, 32*c*, 32*d*, 38 ensures that the telescoping tubular members 32*a*-32*d* move in a nearly linear manner as they are displaced without any significant lateral movement or rattling. As best shown in the sectional view of FIG. 10, the peripheral cap member 34 is provided with a continuous slot in the rear thereof for engaging the proximal end of the outer tubular member 32*c*. In addition, as illustrated in FIG. 10, the cap member 34 is provided with a centrally disposed aperture therethrough for allowing the passage of the inner tubular member 32*b*. In this figure, it also can be seen that the distal end of the inner tubular member 32*b* is preferably provided with a solid cap member 36 to create a snugger fit between the sliding inner tubular member 32*b* and the inner surface of the outer tubular member 32*c* so as to enhance the engagement between the two components 32*b*, 32*c*. The cap member 36 additionally ensures that the inner tubular member 32*b* moves in a nearly linear manner as it is displaced without any significant lateral movement or rattling. In order to achieve this result, the cap member 36 has a flanged end 40 with an outer periphery that contacts the inner surface of the outer tubular member 32*c*. As depicted in FIG. 10, the cap member 36 is inserted into the distal end of the inner tubular member 32*b* until the inner rim of its flanged end 40 abuts the peripheral edge of the inner tubular member 32*b*. When the inner tubular member 32*b* is in its fully extended position, the flanged end 40 of the cap member 36 contacts the inner annular surface of the cap member 34, thereby preventing inner tubular member 32*b* from becoming disengaged from the outer tubular member 32*c* (i.e., by preventing any further sliding of the inner tubular member 32*b* relative to the outer tubular member 32*c*).

While only the tubular members 32*b*, 32*c* are illustrated in conjunction with FIGS. 9 and 10, it is to be understood that the details of peripheral cap member 34 and the solid cap member 36 depicted therein are typical for all of the cap members 34, 36 that are utilized in the golf ball retriever 22.

In a preferred embodiment of the invention, the cap members 34, 36 are both formed from a semi-rigid polymeric material or rubber that is capable of being slightly deformed, such as polyvinyl chloride (PVC) or polyethylene (PE). Forming the cap members 34, 36 from a semi-rigid polymeric material not only enables the cap members 34, 36 to dampen vibrations during the movement of the inner tubular members, but also enables the cap members 34, 36 to be deformed and fitted over the ends of the tubular members 32*a*, 32*b*, 32*c*, 32*d*, 38.

As depicted in the illustrative embodiment of FIG. 9, the cap member 34 preferably is provided with a plurality of grooves 42 spaced apart about the circumference thereof. The grooves 42 enhance the functionality of the golf ball retriever 22 in a number of ways. First, the grooves 42 in each of the cap members 34 make it easier for a user to extend the various tubular members 32*a*-32*d* by reducing the possibility that the user's fingers will slip on the outer surfaces of cap members 34 when he or she grasps these surfaces during the extension of the tubular members 32*a*-32*d*. Secondly, the grooves 42 reduce the amount of stock material that is required to form the cap members 34, thereby reducing the overall manufacturing cost of the golf ball retriever 22.

As best shown in FIGS. 7 and 8, the gripping device 28 covers a portion of the overall length of the outermost tubular member 38 so that a majority of a user's hand contacts the gripping device 28, rather than the outer surface of the outermost tubular member 38. This design enables a user to maintain a better grip on the golf ball retriever 22 when he or she is retrieving a golf ball 10. The gripping device 28 is preferably formed from a generally annular rubber grip. Also, in a preferred embodiment, the outer circumferential surface of the gripping device 28 is provided with a plurality of dimples or a plurality elongated grooves therein to enhance the user's grip on the golf ball retriever 22 by reducing slippage.

Now, turning to FIGS. 11 and 12, the features of the body portion 24 of the golf ball retriever 22 will be described in detail. In the illustrated embodiment, the body portion 24 has a primary body portion 24*a* that has a generally cylindrical geometry, and more particularly, is in the form of a disk (i.e., a cylinder with a diameter that is substantially greater than its height). The disk-shaped magnet 30 is disposed within the interior of the primary body portion 24*a*. As best shown in FIG. 12, the body portion 24 also includes a protruding portion 24*b* that extends radially outward from a side of the primary body portion 24*a*. The protruding portion 24*b* of the body portion 24 has a counterbore hole 46 disposed therein for receiving the first end portion of the elongated rod assembly 26. The counterbore hole 46 comprises an inner diameter portion 48 circumscribed by a generally smooth circular wall and an outer diameter portion circumscribed by a circular wall having a plurality of internal threads 50 disposed.

Figure 11:
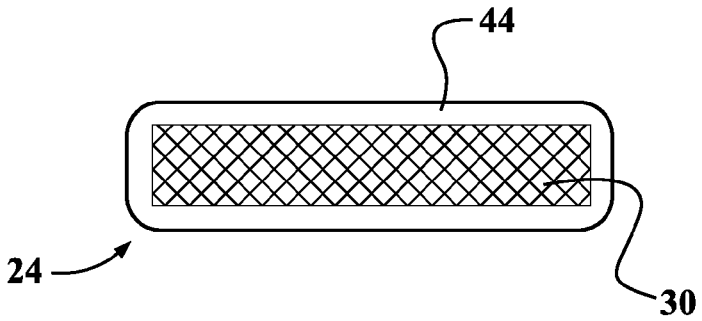
FIG. 11 is a transverse sectional view of a body portion of the golf ball retriever according to an embodiment of the invention, the section being cut along the cutting-plane line C-C in FIG. 12.
Figure 12:
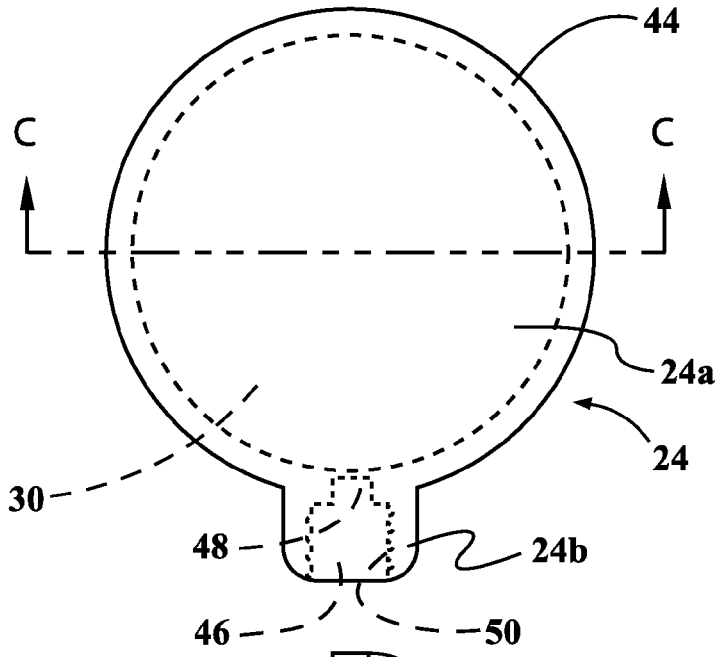
FIG. 12 is a frontal view of the body portion of the golf ball retriever according to an embodiment of the invention.

As illustrated in FIGS. 11 and 12, the disk-shaped magnet 30 in the primary body portion 24*a* is preferably encased within a polymeric material 44, which can be a suitable plastic or rubber. It is advantageous to cover the disk-shaped magnet 30 with a polymeric material 44 for various reasons. First, the polymeric material 44 protects the material of the magnet 30 from being degraded and damaged (i.e., it prevents the magnet 30 from rusting and/or being dented, nicked, and cracked). Secondly, it minimizes the potential for inadvertent interaction between the magnet 30 and nearby metallic surfaces. For example, if the disk-shaped magnet 30 was not covered using a polymeric material 44, the magnet 30 might undesirably adhere to adjoining metallic golf clubs in a golf bag.

In an exemplary embodiment of the invention, a disk-shaped magnet 30 with an outside diameter of two (2) inches has the following specifications: (1) a thickness of three-eighths (3/8) of an inch; (2) material composition: neodymium (NdFeB), Grade N42; (3) plating/coating: Ni—Cu—Ni (triple layer coating for durability and corrosion protection); (4) magnetized through the thickness (i.e., axially magnetized); (5) a pull force of approximately 90 lbs. depending upon the particular mounting arrangement; and (6) a residual flux density (BrMax) of approximately 13,200 Gauss.

Figure 13:
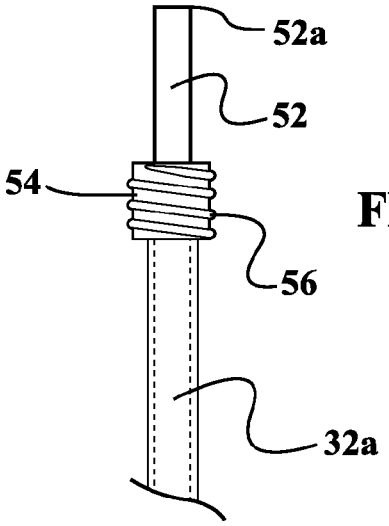
FIG. 13 is a partial, enlarged perspective view of an end portion of the elongated rod assembly of the golf ball retriever according to an embodiment of the invention.

A proximal end portion of the elongated rod assembly 26 is depicted in FIG. 13. As illustrated in this figure, a flexible inner rod 52 is disposed within an innermost one 32*a* of the plurality of telescoping tubular members 32*a*-32*d*. The flexible inner rod 52 has a first, proximal end 52*a* that fixedly attaches to the inner diameter portion 48 of the counterbore hole 46 in the protruding body portion 24*b*. For example, the first end 52*a* of the flexible inner rod 52 can be fixedly secured to the inner diameter portion 48 of the counterbore hole 46 in the protruding body portion 24*b* by utilizing a suitable adhesive. The second, opposed end of the flexible inner rod 52 is slidably disposed within an interior portion of the innermost one 32*a* of the plurality of telescoping tubular members 32*a*-32*d*. In FIG. 13, it can be seen that a coupling member 54 is disposed on a first, proximal end of the innermost one 32*a* of the plurality of telescoping tubular members 32*a*-32*d*, wherein the coupling member 54 includes a plurality of external threads 56 disposed about the periphery thereof.

The flexible inner rod 52 is fixed in place relative to the innermost one 32*a* of the plurality of telescoping tubular members 32*a*-32*d* when the external threads 56 of the coupling member 54 are engaged with the complementary internal threads 50 disposed on the protruding body portion 24*b*. In contrast, the flexible inner rod 52 is extendable from the innermost one 32*a* of the plurality of telescoping tubular members 32*a*-32*d* when the external threads 56 of the coupling member 54 are disengaged from the complementary internal threads 50 of the protruding body portion 24*b*.

Now, referring to FIGS. 14-17, the functionality of the golf ball retriever 22 will be described in detail. When used to retrieve a golf ball 10, the golf ball retriever 22 can be oriented in a number of different ways. A first possible orientation of the golf ball retriever 22 is illustrated in FIGS. 14 and 15, whereas a second possible orientation of the golf ball retriever is depicted in FIGS. 16 and 17.

Figure 14:
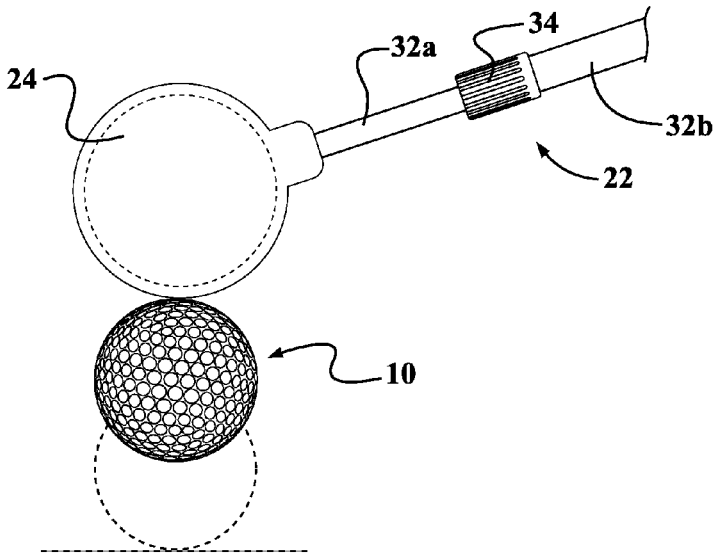
FIG. 14 is a partial perspective view of the golf ball retriever radially grasping a golf ball according to an embodiment of the invention, wherein a flexible inner rod of the elongated rod assembly is in a retracted position.

In FIG. 14, the golf ball retriever 22 is shown radially grasping a golf ball 10 only using the generally rigid telescoping tubular members 32*a*, 32*b* of the elongated rod assembly 26. In this figure, the flexible inner rod 52 of the elongated rod assembly 26 is not being used to retrieve the golf ball 10, and thus, remains retracted inside of the innermost one 32*a* of the plurality of telescoping tubular members 32*a*-32*d*. That is, in the FIG. 14 depiction of the golf ball retriever 22, the external threads 56 of the coupling member 54 are engaged with the complementary internal threads 50 disposed on the protruding body portion 24*b* so as to hold the flexible inner rod 52 inside the innermost telescoping tubular member 32*a*. This configuration of the golf ball retriever 22 is desired when the flexibility of the flexible inner rod 52 has the potential to interfere with the successful retrieval of the golf ball 10 (e.g., when the golf ball 10 is imbedded in mud, etc.).

Figure 15:
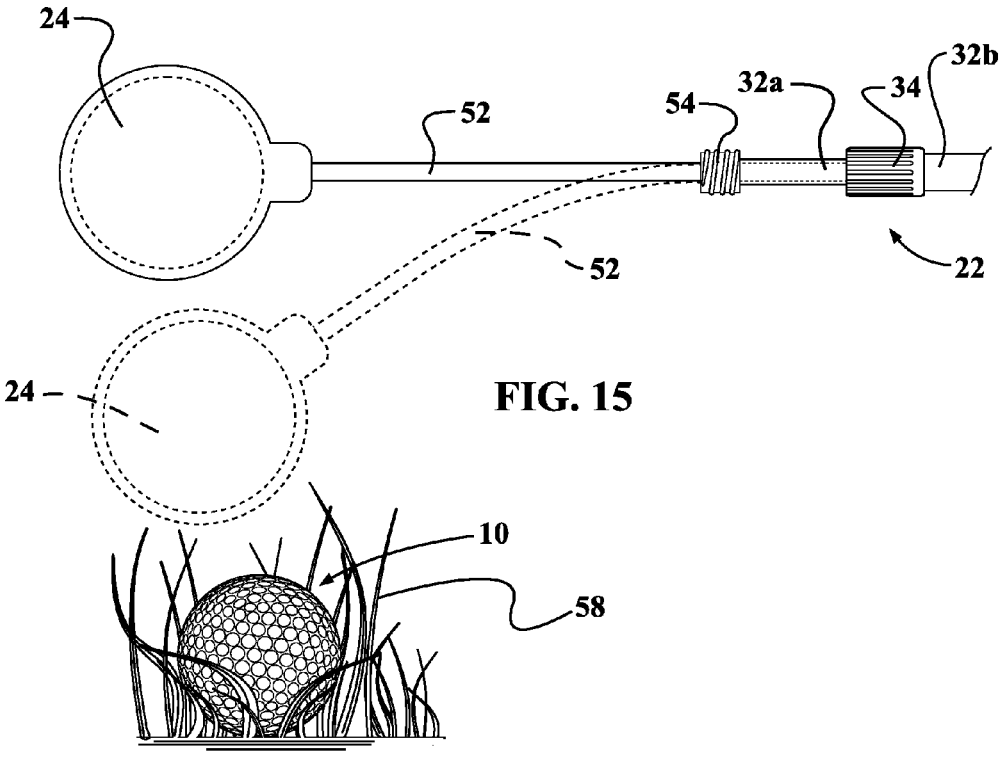
FIG. 15 is a partial perspective view of the ball retriever body portion radially approaching a golf ball according to an embodiment of the invention, wherein a flexible inner rod of the elongated rod assembly is in an extended position.

In contrast to FIG. 14, the golf ball retriever 22 illustrated in FIG. 15 is radially approaching a golf ball 10 using both the generally rigid telescoping tubular members 32*a*, 32*b* and the flexible inner rod 52 of the elongated rod assembly 26. In this figure, the flexible inner rod 52 of the elongated rod assembly 26 has been extended from the proximal end of the innermost one 32*a* of the plurality of telescoping tubular members 32*a*-32*d*. In the FIG. 15 depiction of the golf ball retriever 22, the external threads 56 of the coupling member 54 are disengaged from the complementary internal threads 50 disposed on the protruding body portion 24*b*, thereby permitting the flexible inner rod 52 to be extended as shown. This configuration of the golf ball retriever 22 is desired when the flexibility of the flexible inner rod 52 is needed to retrieve a golf ball 10 that is not readily visible to the user (e.g., when the golf ball 10 is buried in thick grass 58). Advantageously, in such a case, the flexibility of the flexible inner rod 52 provides the golf ball retriever 22 with an added tactile feature. The magnetic field, which exists between the magnet 30 and the golf ball 10 having a metallic material 18 disposed therein, has the effect of drawing the body portion 24 towards the golf ball 10 when the body portion 24 is in sufficient proximity to the golf ball 10. As shown in FIG. 15, when the body portion 24 of the golf ball retriever 22 is drawn towards the golf ball 10, the flexible inner rod 52 is elastically deformed. Because a user has one or more hands on the gripping device 28 of the golf ball retriever 22, he or she is able to feel the deformation (i.e., flexing) of the flexible inner rod 52. This additional tactile feature of the golf ball retriever 22 greatly enhances the functionality of the device by making it much easier for a user to find a golf ball 10 that is mostly concealed from view.

FIG. 16 is similar in most respects to FIG. 14. However, rather than the golf ball retriever 22 radially grasping the golf ball 10 as illustrated in FIG. 14, the golf ball retriever 22 depicted in FIG. 16 is axially grasping the golf ball 10, while its flexible inner rod 52 remains in a retracted position. FIG. 17 is also similar in most respects to FIG. 15. Although, rather than the golf ball retriever 22 radially approaching the golf ball 10 as illustrated in FIG. 15, the golf ball retriever 22 depicted in FIG. 17 is axially approaching the golf ball 10 with its flexible inner rod 52 being in an extended position.

In one preferred embodiment of the invention, the golf ball retriever 22 exerts an attractive force ranging from approximately 0.45 Newtons to approximately 21.6 Newtons on the golf ball 10 (or between 0.45 Newtons and 21.6 Newtons), and more preferably between approximately 0.90 Newtons and approximately 10.8 Newtons (or between 0.90 Newtons and 10.8 Newtons). The low end of the range (i.e., approximately 0.45 Newtons or 0.45 Newtons) represents the minimum attractive force that is required to lift the golf ball 10 (i.e., the minimum attractive force that is required to overcome the gravitational force $-(45.93\ g)*(1\ kg/1000\ g)*(9.81\ m/s^2)=0.45$ Newtons). The high end of the range (i.e., approximately 21.6 Newtons or 21.6 Newtons) represents the maximum attractive force that is required to extract the golf ball 10 out of a viscous material, such as clay or mud, without breaking the link between the golf ball and the permanent, disk-type magnet hereinafter described.

Figure 18:
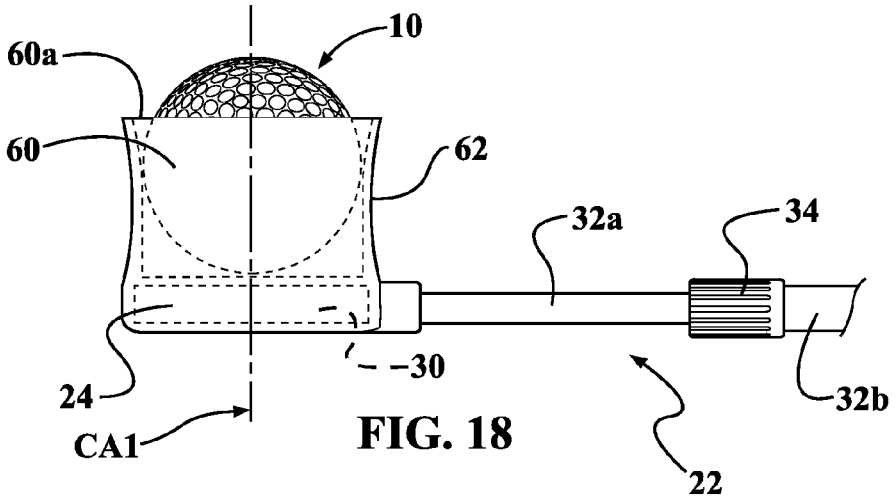
FIG. 18 is a partial perspective view of the body portion of the golf ball retriever according to one alternative embodiment of the invention.

One alternative embodiment of the body portion 24 of the golf ball retriever 22 is illustrated in FIG. 18. In this embodiment, the body portion 24 further comprises a cup portion 60 defined by a cylindrical wall 62 disposed about the periphery of the disk-shaped magnet 30 and extending axially outward therefrom. As shown in FIG. 18, the end 60*a* of the cup portion 60 disposed opposite to the magnet 30 is open so as to permit the receiving of the golf ball 10 into the cup portion 60. Also, as depicted in FIG. 18, the cylindrical wall 62 has an inwardly concave shape such that the cup portion 60 is capable of frictionally engaging the golf ball 10. The frictional engagement between the inwardly concave cylindrical wall 62 and the golf ball 10 prevents the golf ball 10 from becoming inadvertently dislodged from the cup portion 60 when a user is attempting to retrieve the golf ball 10. In addition, the cylindrical wall 62 enables the golf ball retriever 22 to be utilized for retrieving non-metallic golf balls, as well as the metallic golf ball 10. As shown in FIG. 18, the central axis CA1 is disposed through the center point of the magnet 30.

In a preferred embodiment, the cup portion 60 is formed from a polymeric material or rubber that is capable of being elastically deformed, such as a flexible plastic or elastomer. Forming the cup portion 60 from an elastically deformable plastic or rubber advantageously enables the cup portion 60 to frictionally engage the golf ball 10 as desired.

Figure 19:
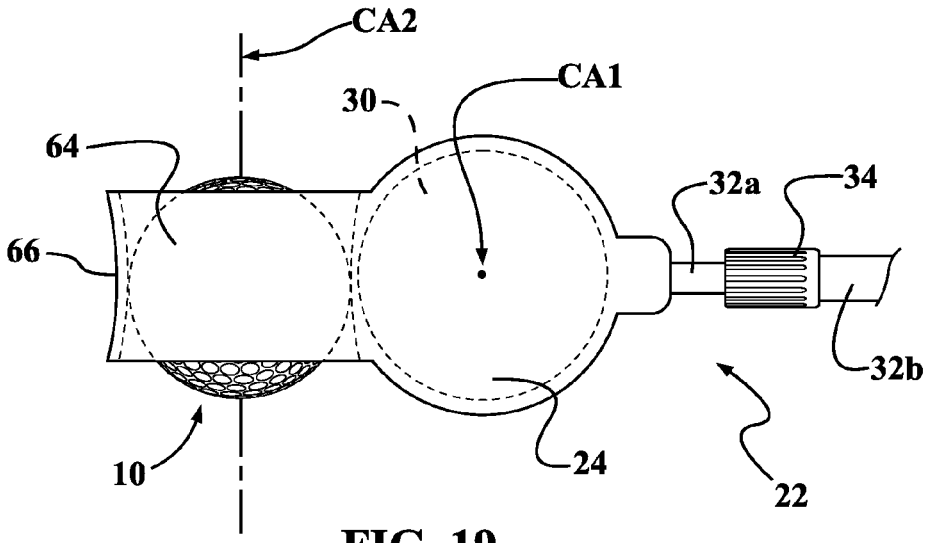
FIG. 19 is a partial perspective view of the body portion of the golf ball retriever according to another alternative embodiment of the invention.

Another alternative embodiment of the body portion 24 of the golf ball retriever 22 is illustrated in FIG. 19. In this embodiment, the body portion 24 further comprises a ring portion 64 defined by an annular wall 66 disposed adjacent to the disk-shaped magnet 30. As shown in FIG. 19, the annular wall 66 is disposed about a central axis CA2 that is oriented generally transversely with respect to a central axis CA1 of the magnet 30. Also, as depicted in FIG. 19, the annular wall 66 has an inwardly concave shape so that the ring portion 64 is capable of frictionally engaging the golf ball 10. Like the frictional engagement between the inwardly concave cylindrical wall 62 and the golf ball 10 in the embodiment of FIG. 18, the frictional engagement between the inwardly concave annular wall 66 and the golf ball 10 prevents the golf ball 10 from becoming inadvertently dislodged from the ring portion 64 when a user is attempting to retrieve the golf ball 10. In addition, similar to the cylindrical wall 62 in the FIG. 18 embodiment, the annular wall 66 enables the golf ball retriever 22 to be utilized for retrieving non-metallic golf balls, as well as the metallic golf ball 10. Also, similar to the cup portion 60 in FIG. 18, the ring portion 64 is preferably formed from a polymeric material or rubber that is capable of being elastically deformed, such as a flexible plastic or elastomer.

Figure 20:
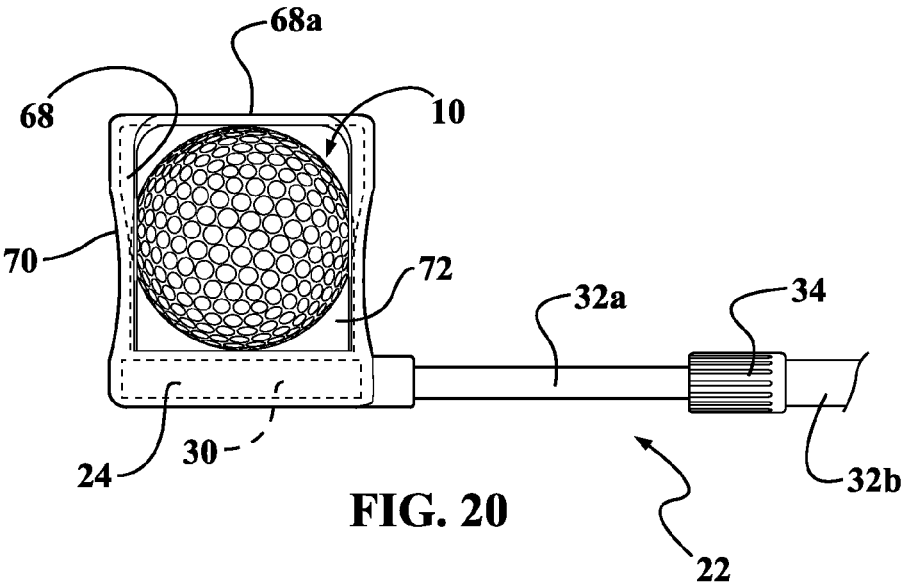
FIG. 20 is a partial perspective view of the body portion of the golf ball retriever according to yet another alternative embodiment of the invention.

Yet another alternative embodiment of the body portion 24 of the golf ball retriever 22 is illustrated in FIG. 20. In this embodiment, the body portion 24 further comprises a cup portion 68, which, like the cup portion 60, is defined by a cylindrical wall 70 disposed about the periphery of the disk-shaped magnet 30 and extending axially outward therefrom. Although, unlike the cup portion 60 in FIG. 18, the end 68*a* of the cup portion 68 disposed opposite to the magnet 30 is solid, and the cylindrical wall 70 of the cup portion 68 is provided with an aperture 72 disposed therein so as to permit the receiving of the golf ball 10 into the cup portion 68. Like the cup portion 60 in FIG. 18, the cylindrical wall 70 of the cup portion 68 has an inwardly concave shape so that the cup portion 68 is capable of frictionally engaging the golf ball 10.

In addition, similar to the cup portion 60 in FIG. 18, the cup portion 68 of FIG. 20 is preferably formed from a polymeric material or rubber that is capable of being elastically deformed, such as a flexible plastic or elastomer.

Although the invention has been shown and described with respect to a certain embodiment or embodiments, it is apparent that this invention can be embodied in many different forms and that many other modifications and variations are possible without departing from the spirit and scope of this invention.

For example, while it is preferred to provide the metallic material 18 in the form of a ferrous powder dispersed inside the golf ball 10, the inventors have also contemplated using a lightweight metal center core as an alternative to the ferrous powder. In such arrangement, the metal center core could be spherical or cylindrical in shape as long as it is capable of achieving the same or similar effect.

Moreover, as another example, while it is preferred to utilize a disk-shaped magnet, the inventors have also contemplated using other shapes for the magnet 30, such as a ring shape, a rod shape, and a bar shape. Also, in other embodiments of the invention, one of the circular faces of the disk-shaped magnet can be provided with a concave indentation in a center portion thereof so as to receive a portion of the golf ball 10 in the indentation, thereby enhancing the grip thereon.

In one embodiment of the invention, the body portion 24 of the golf ball retriever 22 is provided with a cover thereon so as to minimize the interaction between the magnet 30 and adjacent metallic golf clubs in a golf bag. The golf ball retriever cover can be formed from a semi-rigid plastic material, rubber, foam, fabric, or any suitable combination thereof. In addition to preventing the undesirable interaction between the magnet 30 of the golf ball retriever 22 and adjacent metallic golf clubs, the cover will also protect the magnet 30 from becoming damaged (i.e., it will prevent dents and nicks resulting from adjacent golf clubs in the golf bag striking the magnet 30).

While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A golf ball retriever configured to retrieve a golf ball having a metallic material disposed therein, said golf ball retriever comprising:

an elongated rod assembly having a distal end portion configured to be grasped by a user and a proximal end portion disposed opposite to said distal end portion; and a body portion, said proximal end portion of said elongated rod assembly being fixedly attached to said body portion, said body portion including a circular magnet with a circular peripheral sidewall that is configured to magnetically attract said golf ball with said metallic material disposed therein, said body portion further including a protruding portion extending radially outward from said circular peripheral sidewall of said circular magnet, said proximal end portion of said elongated rod assembly being disposed within said protruding portion of said body portion;

wherein said elongated rod assembly extends radially outward from said circular peripheral sidewall of said circular magnet of said body portion;and wherein said elongated rod assembly comprises a plurality of telescoping tubular members such that the extending length of said golf ball retriever is capable of being adjusted; wherein said elongated rod assembly further comprises: a flexible inner rod disposed within an innermost one of said plurality of telescoping tubular members, said flexible inner rod having a first end that is fixedly attached to a hole inside said protruding portion of said body portion and a second, opposed end that is slidably disposed within an interior portion of said innermost one of said plurality of telescoping tubular members; and a coupling member disposed on a first end of said innermost one of said plurality of telescoping tubular members, said coupling member including a plurality of external threads disposed about the periphery thereof; wherein said flexible inner rod is fixed in place relative to said innermost one of said plurality of telescoping tubular members when said external threads of said coupling member are engaged with complementary internal threads disposed inside said protruding portion of said body portion, and wherein said flexible inner rod is extendable from said innermost one of said plurality of telescoping tubular members when said external threads of said coupling member are disengaged from said complementary internal threads of said body portion, wherein, in an extended position, said flexible inner rod is configured to elastically deform providing tactile feature to a user when said circular magnet exerts an attractive magnetic force on said golf ball with said metallic material disposed therein; and wherein the deformation of said flexible inner rod could also be visually noticed by the user.

2. The golf ball retriever according to claim 1, wherein said circular magnet of said body portion is encased within a polymeric material.

3. The golf ball retriever according to claim 1, wherein said body portion further comprises a cup portion defined by a cylindrical wall disposed about the periphery of said circular magnet and extending axially outward therefrom, said cylindrical wall having an inwardly concave shape such that said cup portion is capable of frictionally engaging said golf ball, said cylindrical wall defining a ball receiving cavity for holding said golf ball therein, said ball receiving cavity having a middle section and opposed end sections disposed on opposite sides of said middle section, wherein, as a result of said inwardly concave shape of said cylindrical wall, said middle section of said ball receiving cavity has a smaller cross-sectional area than said opposed end sections of said ball receiving cavity.

4. The golf ball retriever according to claim 3, wherein the end of said cup portion disposed opposite to said circular magnet is open so as to permit the receiving of said golf ball into said cup portion.

5. The golf ball retriever according to claim 3, wherein said cup portion has a solid end wall that is spaced apart from said circular magnet by said ball receiving cavity, said solid end wall of said cup portion is disposed opposite to said circular magnet, and said cylindrical wall of said cup portion is provided with an aperture disposed therein so as to permit the receiving of said golf ball into said cup portion.

6. The golf ball retriever according to claim 1, wherein said body portion further comprises a ring portion defined by an annular wall disposed adjacent to said circular magnet, said annular wall disposed about a central axis that is oriented generally transversely with respect to a central axis of said circular magnet, and said annular wall having an inwardly concave shape such that said ring portion is capable of frictionally engaging said golf ball.

7. The golf ball retriever according to claim 1, wherein said circular magnet comprises neodymium.

8. The golf ball retriever according to claim 7, wherein said circular magnet has a residual flux density of approximately 13,200 gauss.

9. The golf ball retriever according to claim 1, wherein said circular magnet comprises one of the following: (i) a disk-shaped magnet; and (ii) a ring-shaped magnet.

10. A golf ball retrieving system comprising:

a golf ball including:

(a) two-piece ball construction with an inner core and an outer skin surrounding said inner core or (b) at least three-piece ball construction with an inner core, at least one mantle layer surrounding said inner core, and an outer skin surrounding said at least one mantle layer; and a metallic material disposed in one of: (i) said inner core, (ii) said at least one mantle layer, (iii) said outer skin, (iv) a space between said inner core and said outer skin, (v) a space between said inner core and said at least one mantle layer, and (vi) a space between said at least one mantle layer and said outer skin, said metallic material being in the form of a ferrous powder; and a golf ball retriever configured to retrieve said golf ball, said golf ball retriever including:

an elongated rod assembly having a distal end portion configured to be grasped by a user and a proximal end portion disposed opposite to said distal end portion; and a body portion, said proximal end portion of said elongated rod assembly being fixedly attached to said body portion, said body portion including a circular magnet with a circular peripheral sidewall that is configured to magnetically attract said golf ball with said ferrous powder disposed therein, said body portion further including a protruding portion extending radially outward from said circular peripheral sidewall of said circular magnet, said proximal end portion of said elongated rod assembly being disposed within said protruding portion of said body portion;

wherein said elongated rod assembly extends radially outward from said circular peripheral sidewall of said circular magnet of said body portion; and wherein said elongated rod assembly comprises a plurality of telescoping tubular members including an innermost rod that is elastically deformable to provide tactile feature to a user; and wherein the deformation of the innermost rod could also be visually noticed by the user.

11. The golf ball retrieving system according to claim 10, wherein said golf ball retriever is configured to exert an attraction force ranging from approximately 0.90 Newtons to approximately 21.6 Newtons on said golf ball.

* * * * *